United States Patent [19]

Baffo et al.

[11] 4,023,664

[45] May 17, 1977

[54] AUTOMATIC TYPEWRITER

[75] Inventors: Mariano Baffo, Woburn; William F. Brine, Jr., Melrose, both of Mass.

[73] Assignee: Ty-Data, Inc., Nashua, N.H.

[22] Filed: June 4, 1975

[21] Appl. No.: 583,678

[52] U.S. Cl. ..... 197/19; 197/71; 197/107; 197/176

[51] Int. Cl.[2] ..... B41J 5/30; B41J 29/00

[58] Field of Search ..... 178/17 C, 79–81; 197/19, 71, 20, 107, 176–179

[56] References Cited

UNITED STATES PATENTS

| | | | |
|---|---|---|---|
| 3,372,788 | 3/1968 | Siegel et al. | 197/19 |
| 3,391,774 | 7/1968 | Greer | 197/19 |
| 3,414,103 | 12/1968 | Knudsen et al. | 197/20 |
| 3,452,851 | 7/1969 | Holmes | 197/19 |
| 3,453,379 | 7/1969 | Holmes | 197/19 X |
| 3,502,187 | 3/1970 | Becking et al. | 197/20 |
| 3,643,773 | 2/1972 | Holmes | 197/19 X |
| 3,658,161 | 4/1972 | Holmes | 197/19 |
| 3,724,630 | 4/1973 | Manson | 197/19 |
| 3,757,920 | 9/1973 | Wolf et al. | 197/19 |
| 3,802,545 | 4/1974 | Becker | 197/19 |

*Primary Examiner*—Edgar S. Burr
*Assistant Examiner*—Paul T. Sewell
*Attorney, Agent, or Firm*—Cesari and McKenna

[57] ABSTRACT

Apparatus for converting code responsive, bail operated electric typewriter into an automatic typewriter. The apparatus includes discrete sensing, actuating or combined sensing-actuating assemblies disposed in existing cavities formed by the typewriter mechanism. Each assembly connects to the typewriter frame and is positioned to respond to various selection linkages in the typewriter or to actuate them. As each assembly separately mounts to and fits entirely within existing cavities, the overall profile of the typewriter mechanism does not change.

23 Claims, 12 Drawing Figures

AUTOMATIC TYPEWRITER

BACKGROUND OF THE INVENTION

This invention relates to automatic typewriters and, more specifically, to apparatus for converting conventional office typewriters to operate as automatic typewriters.

Automatic typewriters are used in automated typing, computer, message transfer and other systems and applications. In such applications, these typewriters perform a data input and transmitting function and a signal receiving and data output function. During the first function an operator strikes the typewriter keys to simultaneously type on that typewriter and, by means of various sensors, to transfer to signal processing equipment signals representing the typing operations being performed. In an automated typing system, this equipment comprises circuits for transferring the signals to a storage medium; in a computer system, a computer or an input/output controller; and in a message transfer system, another automatic typewriter.

During the signal receiving and data output function, the signal processing equipment transfers character and timing signals to the automatic typewriter. Various actuators cause the typewriter to print in response to these received signals.

A number of such automatic typewriters have been and are now available. They have become more popular with the advent of code responsive, bail operated, electric typewriters. Such typewriters are marketed by IBM under the trademark "Selectric". These electric typewriters are sold both to offices for use as conventional electric typewriters and to other manufacturers to be converted for use as automatic typewriters in the foregoing and other applications.

In one conversion, attachments sense key actuation and externally initiate the functions provided manually by the keys. Specifically, the attachments include an array of switches which are physically attached to the selection linkages in the typewriter that control operation of the typewriter printing head in response to actuation of the respective character keys. Movement of a selection linkage results in operation of a combination of these switches which thereby develop a set of output electrical code signals representing the selected character. The typewriter attachments also include an array of solenoids which are also physically attached to the selection linkages in the machine. Input electrical code signals selectively energize the solenoids to initiate movement of the selection linkages and thus do operate the typewriter printing head.

The principal disadvantage of this arrangement results from the fact that the switches and solenoids are physically attached to the typewriter linkages whose movement they sense or cause. The modified typewriters are therefore typically difficult and expensive to assemble. Special holes must be drilled into the standard typewriter frame to position accurately the switches and solenoids. Maintenance and repair of the machine, as modified, is complicated by the presence of the attachments which cannot be easily or quickly removed. Additionally, most of the solenoids used in the system are mounted as appendages external to the machine case. Apendages of this sort tend to make the machine cumbersome, and are susceptable to damage during movement of the machine from one place to another.

In another conversion, an integral baseplate is fastened to the bottom of the typewriter frame as a unit. This baseplate carries on one surface all of the required switches and solenoids for sensing, transmitting and receiving electrical code signals and for operating the associated typewriter in response thereto. Advantageously, this structure allows the quick and easy conversion of a standard typewriter to an automated typewriter simply by attaching the self-contained, self-aligned baseplate to the typewriter frame. The various switches and solenoids on the baseplate include actuator arms which extend up into the typewriter mechanism to cooperate with the various typewriter linkages to which they react or which they operate. Moreover, this structure requires no direct physical attachment of the various switches and solenoids to the typewriter linkages, and is thus more easily assembled. However, the various actuators and sensors exend significant distances above and below the baseplate and the volume occupied by the baseplace and components beneath it is greater than the space available between the bottom of the typewriter frame and the bottom cover of the typewriter. This alters the overall profile of the typewriter, so additional space must be provided by interposing a spacer band between the sides of the typewriter case and the bottom cover. However, the spacer band adds considerable height to the machine. The operator, therefore, must either adjust the level of his or her chair or of the desk top on which the machine rests, or become accustomed to typing with the typewriter keys at an elevated level.

In still another conversion, various sensors and actuators are grouped into assemblies and discrete elements. These assemblies and elements coact with the typewriter mechanism to provide the data input and transmitting function and the signal receiving and data output function. With this conversion, however, portions of the sensors and actuators also protrude and distort the overall typewriter profile. Hence, this conversion also requires a special typewriter case and a special stand for accommodating these typewriters.

Therefore, it is an object of this invention to provide improved apparatus for converting a code responsive, bail operated, electric typewriter into an automatic typewriter.

Another object of this invention is to provide automatic typewriter conversion apparatus which does not alter the overall profile of the typewriter.

Yet another object of this invention is to provide automatic typewriter conversion apparatus which enables the finally converted typewriter to be housed in a conventional office typewriter case.

SUMMARY OF THE INVENTION

In accordance with this invention, automatic typewriter conversion apparatus comprises a set of discrete sensing and actuating assemblies, each of which is structured so that it can be separately mounted within existing cavities defined within the overall profile of the typewriter. The sensing switches and actuators in the assemblies are equipped with extensions which coact with the various selection linkages in the machine that determine and identify machine operations. However, no direct permanent attachment between these extensions and the machine linkages is required. Thus, a code responsive, bail operated, electric typewriter can be converted easily to serve as an automatic typewriter without altering the existing typewriter frame, the normal operation of the typewriter as a printing instrument, or the overall profile of the typewriter.

This invention is pointed out with particularity in the appended claims. The foregoing and other features and advantages of the invention will be better understood by referring to the following detailed description taken in conjunction with the accompanying drawings.

DETAILED DESCRIPTION OF AN ILLUSTRATIVE EMBODIMENT

Figure 1:
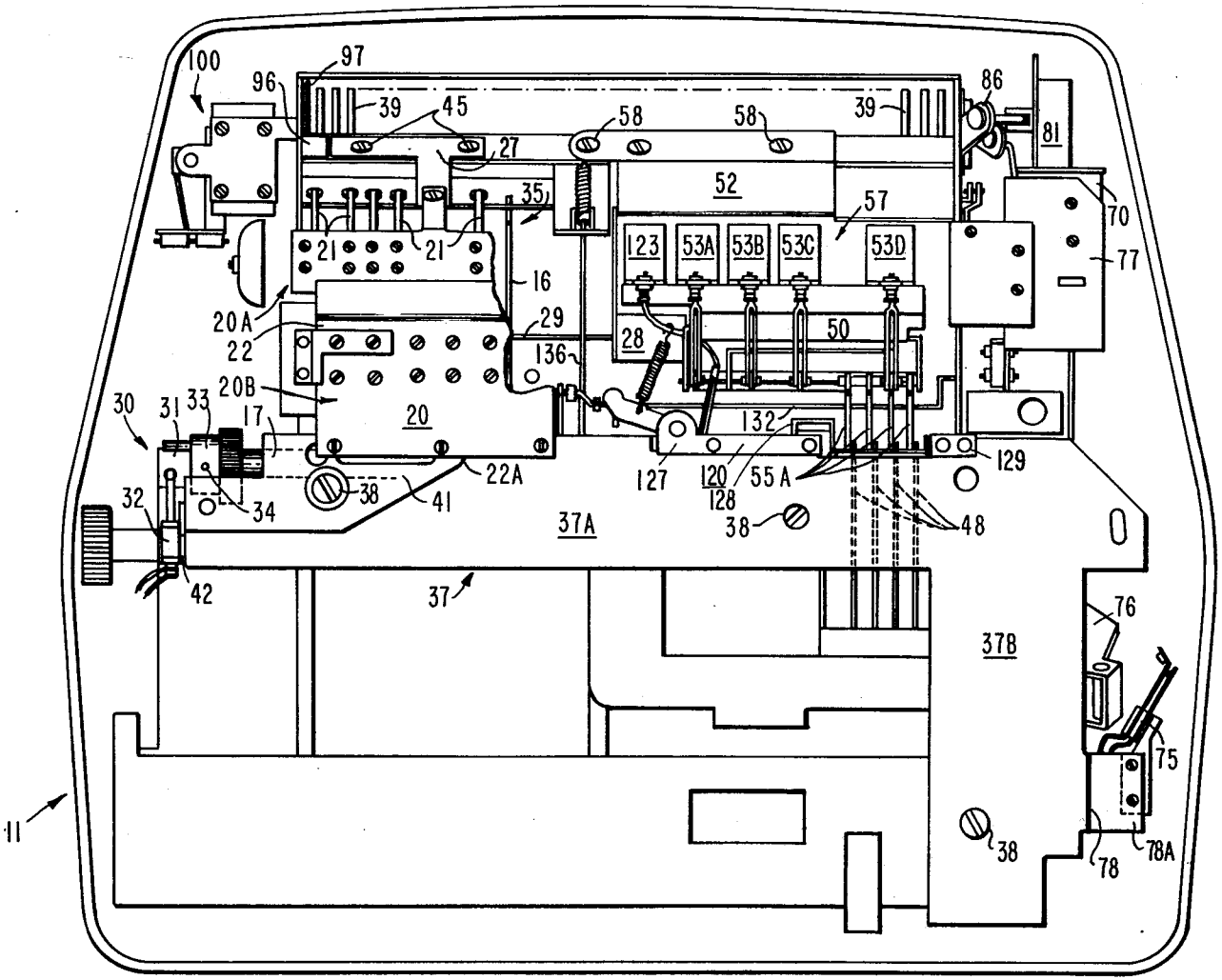
FIG. 1 is a bottom view of an illustrative embodiment of a code responsive, bail operated typewriter modified in accordance with this invention.

FIGS. 1 through 4 show four different views of an illustrative embodiment of the invention in the form of an automatic typewriter utilizing a conventional code responsive, bail actuated, electric typewriter 11. The detailed structure and mode of operation of such typewriters are well known to those skilled in the art. Consequently, the detailed description that follows is limited to an explanation of the various assemblies of the present invention, their arrangement in the typewriter case, and their operation and cooperation with the various well-known parts of the typewriter 11.

In the following description, we refer to a "Manual" which is the "Service Manual for the Selectric Typewriter", published by the IBM Corporation, Office Products Division, Customer Engineering (Form No. 241-5615-1, Reprinted February, 1972), It should be understood, and will be clear from the description below, that although the preferred embodiment of the invention is described in terms of converting a SELECTRIC typewriter, the invention has application to other types and forms of key-actuated printing machines which include linkages moveable in the machine to signify and control the operation of the machine printing unit.

As described generally in the Manual, and shown in FIGS. 1 through 4 of the drawings herein, typewriter 11 is characterized by the presence of a unitary printing head 12 which is moveable relative to a stationary platen 13 against which the paper is held. All characters (including herein other symbols such as commas, brackets, etc.) are located on printing head 12. A selected character is typed, or a selected function is performed, by depressing the appropriate one of a plurality of character and function keys 14 located on top side of the typewriter. Depression of a key 14 actuates an internal linkage mechanism in the machine to initiate the performance of the desired typewriter operation.

To type a character, for example, the desired character key is depressed to actuate an internal character selection linkage which serves to rotate and/or tilt printing head 12 into the proper position for printing the selected character by striking the paper by way of a typewriter ribbon 15. The details of the structure and operation of the character selection linkages in typewriter 11 are described in pages 12 through 14 of the Manual.

Figure 6:
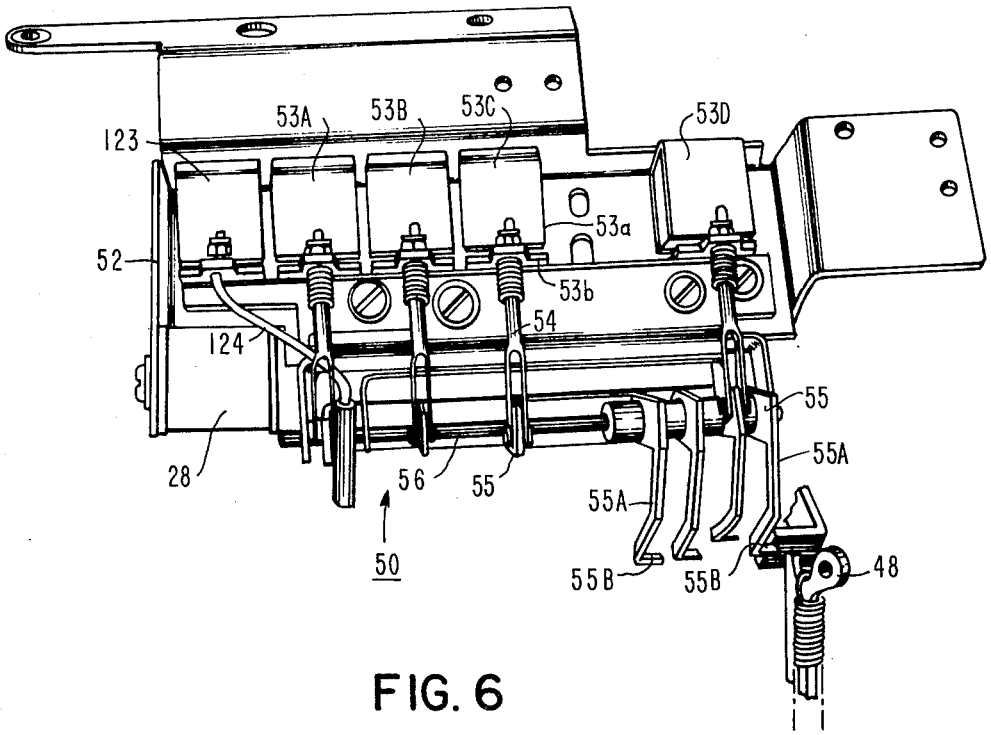
FIG. 6 is a perspective view of an assembly embodied in accordance with the invention for actuating the typewriter function selection linkages including its space, backspace, carrier return and index mechanisms.

More specifically, as shown in FIG. 6 on page 13 of the Manual, each typewriter character key is attached to a key lever and key lever pawl. Depression of a key unlatches a first interposer associated therewith and causes the interposer to be contacted by a rotating filter shaft 17 (FIG. 1) and thus moved thereby toward the front of the machine. A plurality of selector lugs, extending from the lower edge of each interposer, engage a combination of selector bails or rods which extend transversely across the machine. There are six such bails and the particular combination of bails engaged by the selector lugs corresponds to a binary code for the depressed key. Each bail contacted by one of the lugs is thereby caused to move toward the front of the typewriter. Each of th selector bails has associated therewith a second or "latch" interposer 16 (FIG. 1). As the selector bails mmove toward the front of the typewriter, each contacts its associated latch interposer 16 and moves it toward the front of the machine. Each character key depressed thus causes a different combination of the latch interposers 16 to be moved. The combination of latch interposer movements is effective, through other linkages in the machine, to cause the printing head to rotate or tile into the proper position for printing the character corresponding to the depressed key. To summarize, each character key in the typewriter is linked to a different set of latch interposers 16 which move to select a character for printing.

Figure 5:
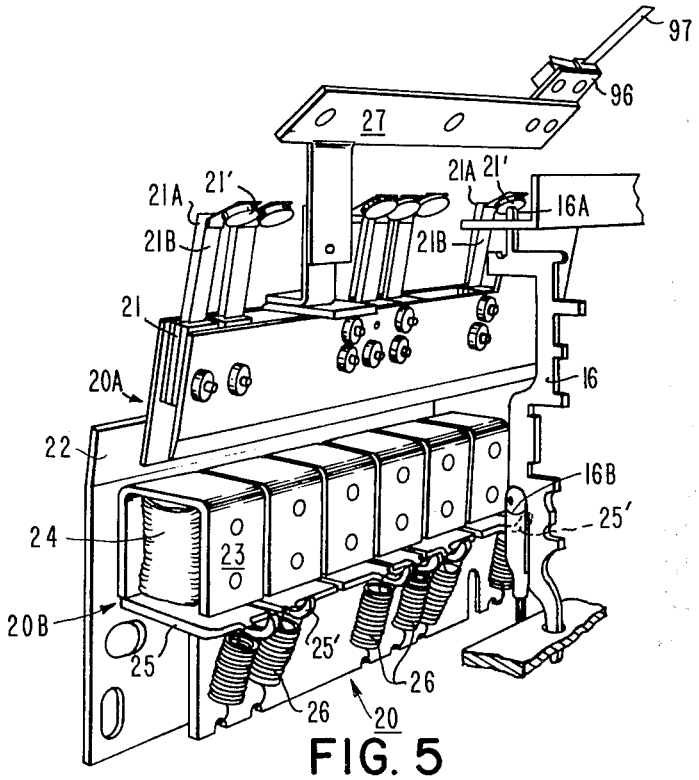
FIG. 5 is a perspective view of an assembly embodied in accordance with the invention for sensing and actuating the typewriter character selection linkages.

FIG. 5 of the drawing herein is a perspective view of an assembly 20 embodied in accordance with the invention for sensing and actuating the typewriter character selection linkages (i.e., latch interposers 16). Assembly 20 is designed so that it both senses and initiates movement of latch interposers 16, which are exposed at the bottom of the typewriter when the typewriter bottom cover is removed.

As shown in FIG. 5, assembly 20 includes a sensing section 20A and an actuating section 20B, both of which are mounted on a bracket 22. The sensing section 20A, in turn, includes a set of switches 21. Each switch 21 comprises a pair of contact arms 21A and 21B mounted between a pair of plates fastened to the bracket 22. The arms 21B are provided with pads 21'. Each pad is angled so that upward (FIG. 5, forward in FIG. 1) movement of a latch interposer 16 will cause the shoulder 16A of the interposer to cam the pad 21' and associated arm 21B toward the mating contact arm 21A and thereby close the switch.

Figure 3:
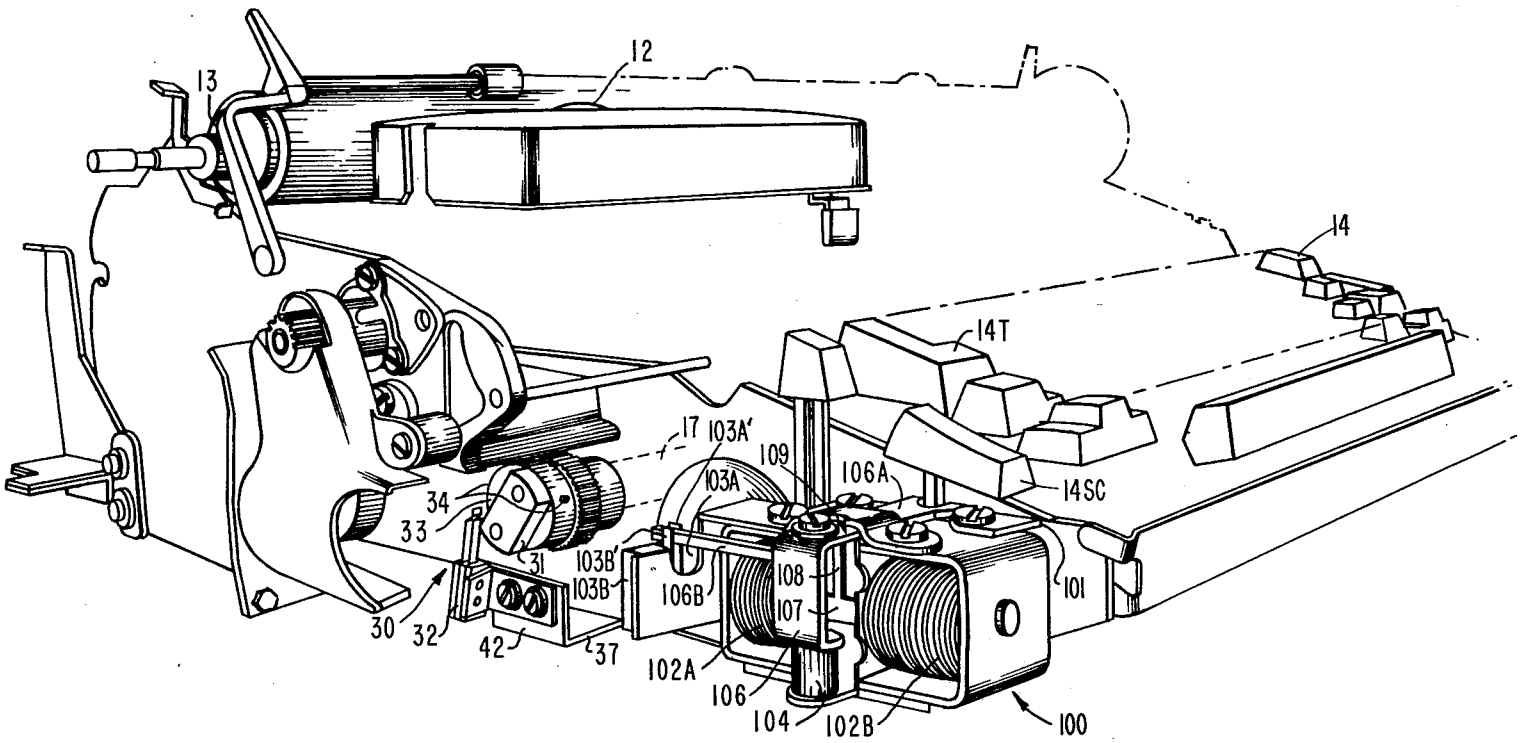
FIG. 3 is a left-front view of the modified typewriter of FIG. 1.

The closing of switches 21 thus corresponds exactly to the selected pattern of movement of the six latch interposers in the typewriter. Specifically, it provicdes a six-bit binary output electrical code word for each character selected by means of the character keys 14 (FIG. 3).

The actuating section 20B in FIG. 5 includes a set of magnetic actuators 23, mounted on the same side of bracket 22 as the switches 21. Each actuator 23 includes an electromagnet 24 and an armature 25 pivotally mounted in proximity to the lower surface of the electromagnet 24. Each armature 25 further includes an integral hook 25' extending outwardly therefrom, as shown. Return springs 26 hold the armatures 25 normally away from the lower surfaces of electromagnets 24.

The hooks 25' are so positioned on the assembly 20 that, when the assembly is mounted to the bottom of typewriter 11 as illustrated in FIG. 1, each of the hooks is disposed in close proximity to a knee-like portion 16B (FIG. 5) at the rear of one of the latch interposers 16 in the typewriter. Then, when an armature 25 is magnetically attracted by its electromagnet 24 in response to an input electrical signal applied thereto, the armature is raised and its associated latch interposer 16 is moved toward the front of the typewriter (upward in FIG. 5). Any combination of movements of the six latch interposers 16 in the typewriter can thus be generated by applying the appropriate electrical control signals to the magnetic actuators 23.

As further shown in FIG. 5, the assembly 20 also includes an angled arm 27 which is used as described below, in mounting the assembly to the typewriter 11.

Referring to FIG. 1, whenever a character key 14 (FIG. 3) is depressed to select a character, printing of the character is initiated by means of a cycle bail 29. The bail 29 is, in effect, moved frontwardly (upward in FIG. 1) by a lug on the key lever as shown in FIG. 6 on page 13 of the Manual. When printing is controlled externally by means of the actuating section 20B of the assembly 20, a timing signal from the signal processing equipment energizes an electromagnet 28. This electromagnet 28 is positioned by an assembly 50 adjacent to the cycle bail 29. As the cycle bail 29 is composed of a magnetic material, the cycle bail 29 shifts toward the electromagnet 28 when it is energized thereby to initiate a printing operation.

Conversely, the signal processing equipment should be signalled whenever a character key 14 is depressed, so that the device will then sense the conditions of the sensing switches 21. This is accomplished by means of the filter shaft 17, which is caused to rotate 180° whenever any of the typewriter keys is depressed. A timing switch assembly 30, shown in FIG. 3, emits the desired signal whenever the shaft 17 rotates. A two-lobe cam 31 is mounted on one end of the filter shaft 17 using a collar 33 which is positioned over the pre-existing gear hub at the end of the filter shaft and is secured thereto using set screws 34. At switch 32 is disposed relative to cam 31, so that every time the filter shaft rotates through 180°, a cam lobe engages the switch 32 and closes it momentarily. The switch 32 is mounted to an upwardly extending projection on a mounting member 37 to be described in more detail below.

Thus, the closing of timing switch 32 generates an electrical timing signal during each print cycle of typewriter 11 which synchronizes the transfer of a character code to the signal processing equipment. When the automatic typewriter receives signals, the externally transmitted timing signal energizes the print cycle electromagnet 28 to initiate the print cycle therein.

Referring to FIG. 1, the assembly 20 has overall dimensions which enable it to fit entirely within the space designated generally at 35, which space is normally vacant in the standard typewriter case. Thus, assembly 20, when operatively disposed, does not protrude beyond the overall typewriter profile, so no case alernation is needed. Together with print cycle electromagnet 28 and timing assembly 30, the assembly 20 provides typewriter 11 with the necessary character printing and sensing controls.

To facilitate the mounting of character sensing and actuating assembly 20, and some of the other assemblies, an L-shaped mounting plate 37 is first attached to the bottom of typewriter 11 as shown in FIG. 1. Mounting plate 37 includes a first main arm 37A extending transversely across the central part of typewriter 11, and a second main arm 37B in the same plane as the arm 37A and extending rearwardly along the right side of the typewriter. The mounting plate 37 is illustratively mounted directly to the main frame of typewriter 11 using three of the four threaded holes 38 which are included in the standard Selectric typewriter for securing the typewriting during shipment. The holes 38 accurately locate the plate 37 relative to the various components of typewriter 11.

Still referring to FIG. 1, the bracket 22 of assembly 20 is mounted at one end (its lower end as seen in FIG. 1) to threaded holes in mounting plate 37, and at the other end (its upper end as seen in FIG. 1) directly to threaded holes 45 which are included in the standard Selectric typewriter main frame for securing the keylever restoring springs 39 to the typewriter (see FIG. 1 on page 12 of the Manual). Arm 27 of bracket 22 is disposed at a slight angle relative to the remainder of the bracket so that it fits flatly against the keylever restoring springs 39. Holes 45 act as guides for achieving the proper horizontal alignment of the switches and actuators in assembly 20 relative to the six latch interposers 16 in the machine. Proper vertical alignment of assembly 20 is achieved by having the bottom (FIG. 1) edge 22A of the bracket 22 abut an alignment plate 41 secured to the left hand portion of mounting plate 37.

As noted earlier, timing switch 32 is mounted to a projection provided in mounting plate 37. More specifically, the leftmost arm 37A, as viewed in FIG. 1, is provided with a projection 42 which exends perpendicularly from the arm 37A toward the top of typewriter 11, a short distance to the left of the typewriter main frame. The projection 42 is best seen in the left-front view of FIG. 3, where timing switch 32 is shown attached. This design allows timing switch 32 to be accurately positioned and oriented relative to cam 31 in an existing hollow in the typewriter case and witout the need to drill a special hole into the typewriter frame.

Typewriter 11 has, in addition to the internal linkages for selecting characters for printing, internal linkages for performing various typewriter functions such as space, backspace, index (line space), and carrier return. Each of these functions is initiated in the typewriter 11 by depressing an appropriate key 14 for that function. The space, backspace, index and carrier return operations are all performed in typewriter 11 by a mechanism of the type described on pages 45 through 51 of the Manual.

Referring to FIG. 1 on page 45 of the Manual, it can be seen that the depression of a key associated with the typewriter function of space, back space, index or carrier return causes its associated keylever to move downwardly, forcing a keylever pawl to urge the edge of an associated interposer 48 downwardly. This downward motion of the interposer 48 causes it to become unlatched from a latch plate and, because the interposer is spring loaded, it continues to move toward the rear of the typewriter. The rearward movement of the interposer operates a mechanism in the typewriter which performs the function corresponding to the depressed key. Thus, each of the functions of space, backspace, index and carrier return has associated therewith a interposer 48 which is characterized by movement toward the rear of the typewriter during operation. These four interposers are conveniently located in a side-by-side parallel relation in the right hand side of the typewriter and are readily accessible when the bottom cover is removed therefrom.

FIG. 6 of the drawing herein is a perspective illustration of the assembly 50, which actuates the typewriter selection linkages (i.e., interposers 48) for the space, backspace, index and carrier return functions. Specifically, the assembly 50 initiates movement toward the rear of typewriter 11 of each of the four interposers 48 associated with four machine functions. As shown in FIG. 6, assembly 50 includes four magnetic actuators 53A–53D, mounted in a closely packed, side-by-side arrangement on a bracket 52. A fifth magnetic actuator shown mounted with actuators 53 is a keyboard lock actuator 123 which will be explained in detail below in connection with FIG. 9.

Each of the function-selecting actuators 53, like the character-selecting actuators 23 of FIG. 5, includes an electromagnet **53*a* and an armature 53*b* mounted adjacent to the lower surface of the electromagnet. Each armature 53B is connected by means of a threaded connecting rod and clevis pin arrangement 54 to a U-shaped transfer link 55 having a depending arm 55A on the lower end of which is a canted hook 55B. The links 55 pivot around on a shaft 56 which is suitably supported from the bracket 52. When a particular one of actuators 53 is energized, causing its armature 53B to be attracted to its electromagnet 53A, an upward pulling force is exerted on its connecting rod 54. The end of the transfer link 55 attached to connecting rod 54 is thus urged upwardly, causing the transfer link to pivot about shaft 56. This causes the arm 55A to move out of the plane of FIG. 6 toward the viewer. When assembly 50 is operatively disposed relative to bottom of typewriter 11, this movement of transfer link 55 is effective in unlatching the interposer 48** associated with a particular one of the four function keys in the typewriter, in exactly the same manner as if a key were depressed.

Assembly 50 is shown mounted to the bottom of typewriter 11 in the upper right hand portion of FIG. 1. The assembly is dimensioned so that it fits entirely within a space designated generally as 57 in FIG. 1, which is normally vacant in the typewriter case. The arms 55A of the four transfer links 55 extend into the typewriter mechanism so that the hooks 55B nest in the area between the keylever pawls and the function selecting interposers 48 which area can be seen in FIG. 1 on page 45 of the Manual. Actuation of a given function selecting actuator 53 in response to an electrical signal applied thereto thus initiates movement of its associated interposer toward the rear of the typewriter and results in the typewriter performing the operation with which that interposer is associated. In particular, in the illustrated assembly 50, actuators 53A through 53D correspond to the typewriter functions of index, backspace, space and carrier return, respectively.

The bracket 52 mounts to the typewriter mechanism 11 in a manner similar to that employed for mounting bracket 22 of assembly 20. The upper end of bracket 52 as seen in FIG. 1 is mounted directly to holes 58 which are included in the standard Selectric typewriter main frame for securing the keylever restoring springs 39. The upper portion of bracket 52 is angled relative to the remainder of the bracket so that it fits flat against the springs 39. Holes 58 serve as guides for accurately aligning assembly 50. The lower end of bracket 52 is attached to mounting plate 37 by means of a keyboard locking mechanism 120 which forms part of assembly 50, but which is separately illustrated in FIG. 9 and described below.

As mentioned above, electromagnet 28 also forms part of assembly 50. It is mounted to the left side of bracket 52 as seen in FIG. 1 in a position just below keyboard lock actuator 123.

Figure 7:
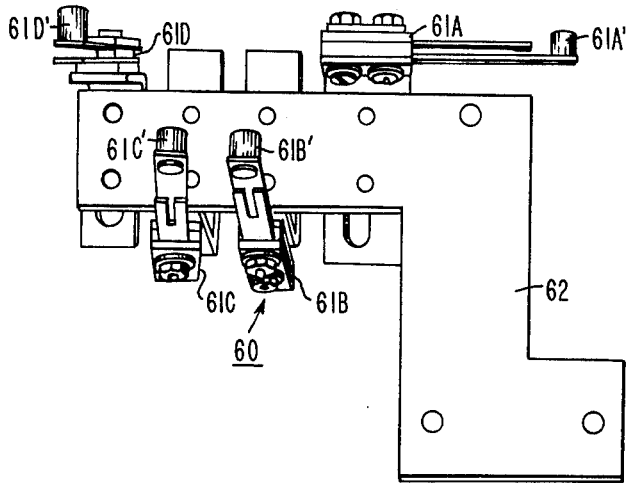
FIG. 7 is a perspective view of an assembly embodied in accordance with the invention for sensing the operation of the typewriter function selection linkages including its space, backspace, carrier return and index mechanisms; and index mechanisms.

In addition to external actuation of the typewriter functions of space, backspace, index and carrier return, it is also necessary to sense when the particular functions have been actuated manually by key depression in an automatic typewriter. FIG. 7 of the drawings herein depicts an assembly 60 for this purpose. Assembly 60 includes four normally open switches 61A–61D, attached to bracket 62 and including contact pads 61A′–61D′. The orientation of switches 61 on bracket 62 is such that, when assembly 60 is operatively disposed relative to typewriter 11 in the manner described below, each contact pad 61′ is located adjacent to a mechanism in the typewriter which moves upon the depression of one of the space, backspace, index or carrier return keys, and which moves in a direction to engage the pad 61′ thus 61 close the switch associated therewith. By sensing which of the switches 61 has closed and which remain open, the device connected to the typewriter 11 can identify electrically which of the particular function keys has been depresssed.

Figure 4:
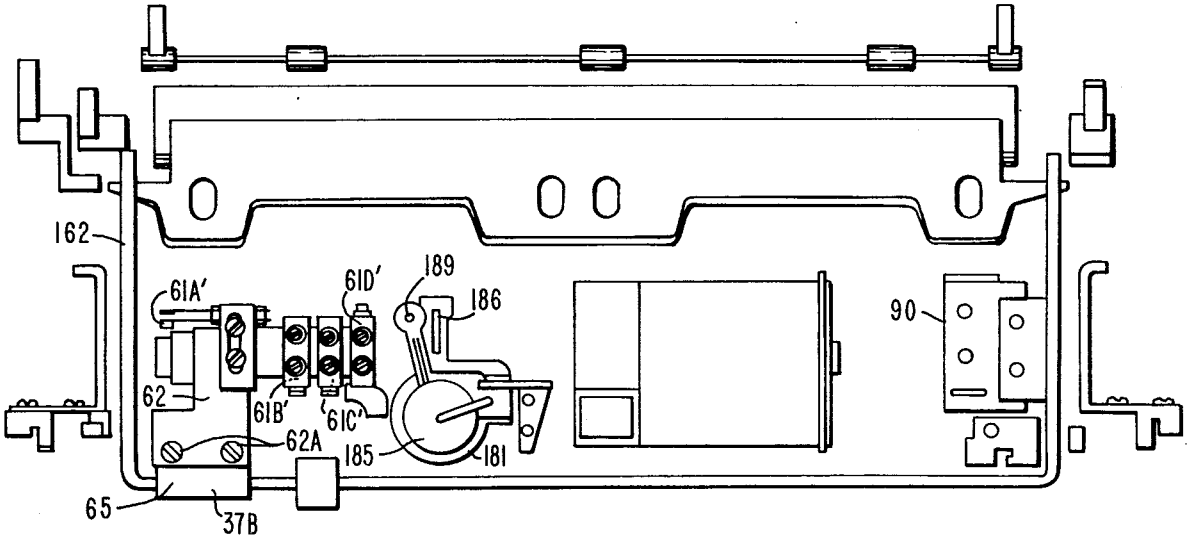
FIG. 4 is a rear view of the modified typewriter of FIG. 1.

Assembly 60 is shown operatively disposed relative to typewriter 11 in the rear view of FIG. 4 herein. The rearmost end of mounting arm 37B is provided with an upward projection 65 just to the rear of the typewriter main frame. Bracket 62 is secured by means of screws 62A to threaded holes provided in projection 65. Contact extensions 61′ thus extend in various directions into the typewriter mechanism.

Specifically, pad 61A′ extends to the left in FIG. 4 or to the right of typewriter 11 as viewed from the front. It is located just above the rearmost end of the index transfer bell crank which is more clearly shown in FIG. 7 on page 153 of the Manual, and which moves upwardly in the typewriter when the index mechanism is operated. Thus, switch 61A is engaged by the bell crank and thereby closed upon the operation of the typewriter index function. Pad 61B′ extends toward the front of typewriter 11 and is located just below the clutch latch shaft adjacent to the carrier return lever (C.R. lever) shown more clearly in the right front view of FIG. 1 on page 63 of the Manual. This portion of the clutch latch shaft moves downwardly in the typewriter and engages pad 61B' when the carrier return mechanism is operated and thus closes switch 61B.

Switch pad 61C' also extends toward the front of typewriter 11 and is located just below the rearwardly protruding arm on the backspace latch assembly shown in FIG. 1 on page 52 of the Manual. This arm moves downwardly in the typewriter when the back space mechanism is operated and thus engages pad pad 61C' and closes switch 61C. Finally, switch pad 61D' also extends toward the front of typewriter 11 and is located just below the rearwardly protruding arm on the spacebar latch lever shown in FIG. 3 on page 46 on the Manual. This arm also moves downwardly in the typewriter when the space mechanism is operated and thus engages pad 61D' to close switch 61D.

The upper case shift mechanism in typewriter 11 is described in detail on pages 18 through 22 of the Manual. Briefly, as shown in FIG. 1 on page 18 of the Manual, two keys situated at each of the lower corners of the typewriter keyboard are used to operate the shift mechanism. These keys are connected through a shift release bell crank and shift release link to a release arm pivotably mounted on a shaft. The shift release arm in turn engages a shift clutch mechanism in the typewriter. When either of the two shift keys is depressed, the release arm is caused to pivot in a counter-clock wise direction as viewed in FIG. 1 on page 18 of the Manual, and this moves the release arm away from the shift clutch mechanism. The clutch then causes a shift arm (76 in FIG. 2 herein) shown in FIG. 2 on page 19 of the Manual, to swing outwardly and, by means of a metal strap and pulley arrangement, to move printing head 12 (FIG. 2 herein) into a position for upper case printing.

When the shift keys are released, the release arm pivots clockwise to again engage the shift clutch mechanism. The typewriter thereby resumes lower case printing.

Figure 2:
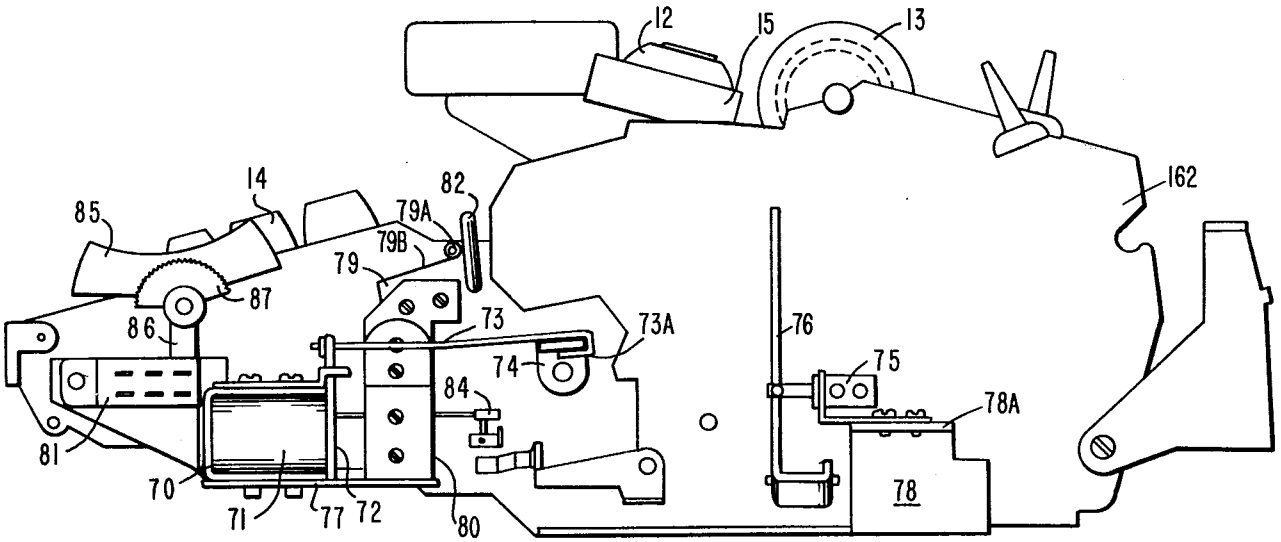
FIG. 2 is a right side view of the modified typewriter of FIG. 1.

The right side view of FIG. 2 herein illustrates an assembly for sensing and actuating the typewriter case shift mechanism. A shift actuator 70 includes an electromagnet 71 and a pivotably mounted armature 72. The armature 72 is connected by means of a threaded connecting rod 73 to the upper portion of the shift release arm 74 in the typewriter shift mechanism. Connecting rod 73 engages the shift release arm 74 by means of a hooked end 73A, thus avoiding physical attachment thereto.

Accordingly, when electromagnet 71 is energized in response to an applied input signal and armature 72 is attracted thereto, it pulls connecting rod 73 toward the front of the typewriter. This causes the shift release arm 74 to pivot exactly as if one of the shift keys has been depressed. Printing head 12 is thus moved into position for upper case printing.

To sense a shift to upper case, shift sensing switch 75 is employed as illustrated in FIG. 2 herein. The switch 75 is a normally open switch disposed relative to the shift arm 76 so that it is closed when the shift arm 76 swings outwardly from the typewriter in a shift to upper case.

As seen in FIG. 2 herein, shift actuator 70 and switch sensing switch 75 are mounted within hollows on the right side of the typewriter which normally exist in the standard typewriter case. To mount shift actuator 70, the bracket 52 of assembly 50 is provided with a projection 77 which extends outwardly to the right in the typewriter and which is more readily visible in the bottom view of FIG. 1. Switch 75 is mounted on a projection 78 of mounting member 37. As seen in FIG. 2, projection 78 extends upward and then outwardly at 78A from the typewriter to provide a flat, horizontal surface on which switch 75 can be secured.

As seen in FIG. 2 herein, the following additional components are supported from the actuator 70: an end-of-line (EOL) switch 79, a dual velocity actuator 80 and a required function and special carrier return switch 81. EOL switch 79 senses the end of a writing line. Switch 79 comprises a normally-open microswitch with a roller 79A attached to an operating arm 79B. The switch is positioned for engagement by bellringer bail 82 in typewriter 11.

As explained on pages 109 through 112 of the Manual, bellringer bail 82 is caused to pivot toward the front of the typewriter and to ring the typewriter bell when the right-hand end of the writing line is being approached, and to lock the keyboard when the right-hand margin has been reached. The pivotal motion of bellringer bail 82 closes EOL switch 79. The relative positioning is such that EOL switch 79 is closed by bellringer bail 82 at the same time that the bellringer bail locks the keyboard at the right hand end of the writing line.

With further reference to FIG. 2, the dual velocity actuator 80 is mounted just to the rear of shift actuator 70. As described on pages 70 through 75 of the Manual, an automatic print head velocity selection mechanism is included in the standard Selectric typewriter to insure that printing head 12 strikes the typewriter ribbon 15 with a lightner impression when the small area characters such as the period, comma, colon, etc. are typed. The link which provides the automatic selection is illustrated in FIG. 6 on page 72 of the Manual, and is shown at 84 in FIG. 2 of the drawing herein. When a period, comma, colon, etc. key is depressed, link 84 moves downwardly and toward the front of typewriter 11 to actuate th lighter-impression mechanism connected to printing head 12. Dual velocity acutator 80 is a magnetic actuator which, when energized, also moves link 84 downwardly and to the front of typewriter 11 in exactly the same manner as if a key for a small area character were depressed. The actuator 80 is electrically connected so as to be actuated everytime an electrical character-designating code word is received by the typewriter corresponding to a small area character.

Required function and special carrier return switch 81 is positioned thereon just to the front of actuator 70. Switch 81 can be used to generate special instructions to control the operation of the signal processing equipment used in conjunction with the typewriter 11. In an automated typing system, for example, the successive depression of a character key, a backspace key, and a different character key in a data input and signal transmitting mode normally causes the character first typed in that space to be erased in the storage medium and the character subsequently typed to be substituted therefor. By actuating the required function portion of switch 81, a special electrical code signal is generated which will allow double typing in the same space, or two or more symbols in one space, for example, when an underscore is required.

When the typewriter 11 performs the signal receiving and data output function, it may be desirable manually to insert a line between two successive, recorded lines stored on the magnetic tape. This can be accomplished by actuating the special carrier return portion of switch 81, so that an electrical signal to the device connected to the typewriter results in the return of the carrier to the left-hand margin of the writing line without immediate printing of the next line. In this way, a line can be typed manually between successive lines on the tape. The typewriter is subsequently returned to a normal playback mode from the tape simply by returning special carrier return switch 81 to a neutral position.

The switch 81 is, in essence, a three-position switch mechanically connected to the standard "on-off" manual switch key 85 through a link 86. The key 85 is rocked forward or backward to provide the two functions controlled thereby and left in a middle, neutral position when neither of these functions is desired. Located just to the right of the ON-OFF key in FIG. 2 is a manual velocity control wheel 87 which allows the operator to adjust manually the automatic velocity control mechanism in the typewriter. To accomodate the required function and special carrier return switch 81 described above, the manual velocity control linkage is illustratively disconnected from the manual velocity control wheel 87 on the keyboard. The ON-OFF linkage is disconnected from the on-off key 85 and then reconnected to the manual velocity control wheel 87. Power to the typewriter is thus turned on or off by rocking what would normally be the manual velocity control wheel 87 either forward or backward.

The typewriter 11 also includes a tabulator mechanism described in detail on pages 55 through 62 of the Manual. FIG. 4 on page 56 of the Manual illustrates the tab actuating mechanism, which is operated by depressing a tab key on the typewriter keyboard. Specifically, depression of the tab key causes a extension of a tab key lever to move toward the rear of the machine. The key lever extension, through a tab keylever link, causes a tab bell crank to pivot clockwise as seen in the Figure in the Manual. This clockwise motion of the tab bell crank imparts an upward motion, through the tab torque bar link, to the tab torque bar. The carrier is thereby moved to the right in the typewriter to a preset position on the writing line.

Figure 8:
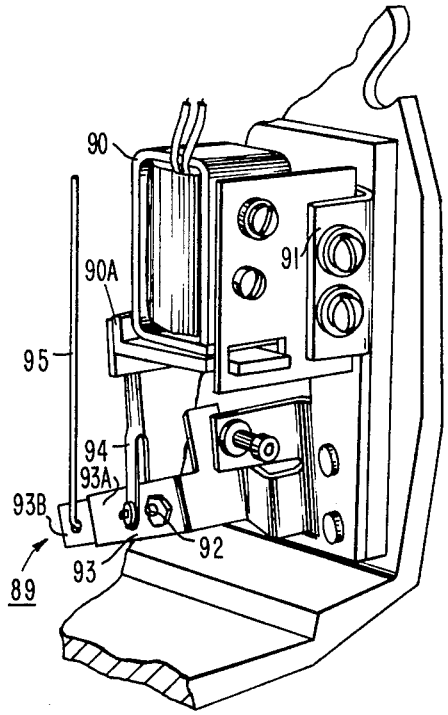
FIG. 8 is a perspective view of an assembly embodied in accordance with the invention for actuating the typewriter tabulator mechanism.

FIG. 8 herein is a perspective view of an assembly 89 for remotely operating the tab mechanism in the typewriter 11. A tab actuator 90 is mounted by means of a bracket 91 to existing holes in the left rear portion of the typewriter main frame (see FIG. 4). Pivotally mounted on a shaft 92 attached to bracket 91 is a transfer link 93. The armature 90A of actuator 90 is connected by means of a threaded rod and clevis pin arrangement 94 to one arm 93A of transfer link 93. The other arm 93B of transfer link 93 is positioned just below one end of the tab bell crank 95 in the typewriter 11. When actuator 90 is energized, its armature moves upwardly, causing the arms of transfer link 93 to pivot upwardly. The tab bell crank 95 is thus forced to pivot and actuate the typewriter tab mechanism in exactly the same manner as if the tab key were depressed.

With reference to FIG. 1 herein, depression of the tab key 14T (FIG. 3) in typewriter 11 is sensed by a tab-sensing switch 96. The switch 96 is a normally open switch which is positioned so that it is forced to close by the downward motion of the front end of the tab keylever 97 when the tab key is depressed. Conveniently, switch 96 is mounted to threaded holes provided in upper arm 27 of bracket 22 of assembly 20, so that no hole drilling into the typewriter frame is required for the attachment.

The tab set and clear mechanism, which allows the operator to set and clear the position where the carrier is stopped when the tab key 14T is pressed, is located in the lefthand portion of typewriter 11 and is shown in FIG. 1 on page 55 of the Manual. The tab set and clear key **14*sc* (FIG. 3** herein) is arranged so that it can be rocked either forward or backward to set or clear the tab stop position on the writing line. When the front or set position of the tab set and clear key is depressed, an extension on the bottom of the key pushes, through a connecting link, a tab set and clear arm causing it to pivot clockwise as seen in the Figure in the Manual. Alternatively, when the rear or clear position of the tab set and clear key is depressed, the extension on the bottom of the key pulls the tab set and clear arm, causing it to pivot counterclockwise as seen in the Figure. This clockwise or counterclockwise movement of the tab set and clear arm is effective through other linkages to set or clear the tap stop position.

In the lower part of FIG. 3 herein, there is shown an assembly 100 for sensing and actuating the tab set and clear mechanism in typewriter 11. Assembly 100 is mounted to the typewriter main frame by means of a bracket 101, using pre-existing holes (not shown) in the main frame. Mounted to bracket 101 are two aligned and facing solenoids 102A and 102B and two aligned and facing microswitches 103A and 103B of the normally open variety. Also mounted to bracket 101 is a vertically extending shaft 104 upon which a transfer link 106 is pivotally mounted. Transfer link 106 includes a first arm 106A extending to the right of typewriter 11 and having an elongated slot therein for engaging the bottom portion of the tab set and clear key **14*sc*. A second arm 106B of transfer link 106 extends toward the rear of the typewriter and is positioned between contact extensions 103A' and 103B' of microswitches 103A and 103B, respectively. Solenoids 102A and 102B share a common piston 107 which maintains an intermediate position when neither solenoid is energized, which is attracted toward solenoid 102A when solenoid 102A is energized and which is attracted toward solenoid 102B when solenoid 102B is energized. A perpendicular extension 108 of piston 107 extends up through an elongated slot 109 in the arm 106A of transfer link 106.**

When the front or set portion of the tab set and clear key **14*sc* is depressed, transfer link 106 is caused to pivot in the counterclockwise direction about shaft 104. Alternatively, when the rear or clear portion of the tab and clear key is depressed, transfer link 106 pivots in the clockwise direction about shaft 104. Counterclockwise motion of transfer link 106 causes arm 106B thereof to close microswitch 103B whereas clockwise motion of transfer link 106 causes arm 106B to close microswitch 103A. Thus, microswitch 103A senses the tab clear operation, whereas microswitch 103B senses the tab set operation. When the tab set and clear key is in a normal, intermediate position, arm 106B of transfer link 106 maintains an intermediate position between the contact extensions of microswitches 103A and 103B** so that neither switch is closed.

The tab set and clear operation in typewriter 11 are thus electrically identified by the status of microswitches 103A and 103B.

To actuate the tab set or clear operation, one or the other of solenoids 102A and 102B is energized. When solenoid 102A is energized, for example, piston 107 is attracted thereto causing transfer link 106 to pivot counterclockwise about shaft 104 and thereby actuate the tab clear mechanism in typewriter 11 in the same manner as if the clear portion of the tab set and clear key 14*sc* were depressed. Energizing solenoid 102B causes piston 107 to be attracted thereto and causes transfer link 106 is pivot clockwise about shaft 104 and actuate the tab set mechanism in typewriter 11, again in the same manner as if the set portion of the key 14*sc* were depressed.

As mentioned above, included in the assembly 50 (FIGS. 1 and 6) are a keyboard locking mechanism 120 and a keyboard lock actuator 123. Keyboard locking mechanism 120 allows all of the keys on the typewriter keyboard to be locked in an inoperative condition when, for example, the typewriter is being used simply as a data receiving and printing device. To better appreciate the structure of keyboard locking mechanism 120, it is shown detached from assembly 50 in FIG. 9 herein.

Figure 9:
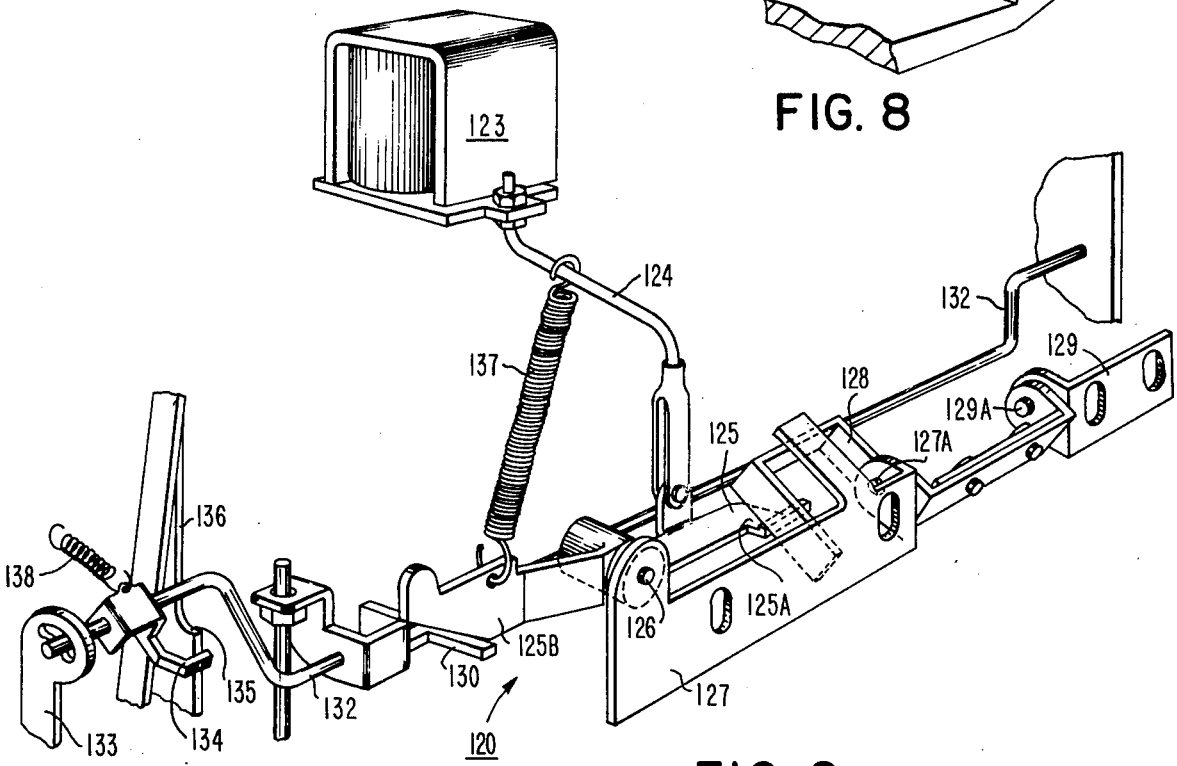
FIG. 9 is a perspective view of an assembly embodied in accordance with the invention for locking the typewrier keyboard in a non-print condition when, for example, the typewriter is being used as data receiver and printer.

As shown in FIG. 9, the keyboard lock actuator 123 is connected by means of a threaded connecting rod and clevis pin 124 to a keyboard locking transfer link 125. Transfer link 125 is pivotally mounted on a shaft 126 which is in turn attached to a bracket 127. Transfer link 125 includes a first arm 125A, extending to the right in FIG. 9, which engages a function key locking crank plate 128. Crank plate 128 is pivotally mounted at one end (its left end as illustrated) to a short shaft 127A protruding from bracket 127 and, at the other end, to a short shaft 129A protruding from a bracket 129. As can be seen in FIG. 1 herein, brackets 127 and 129 are secured to threaded holes provided in the upper righthand portion of arm 37A of plate 37.

The keyboard locking transfer link 125 also includes a second arm 125B extending to the left in FIG. 9. Operatively disposed just below arm 125B is an extension 130 securely attached to a character key locking bail 132. Bail 132 is pivotally mounted in the area between assembly 50 (FIG. 1) and the internal mechanism of typewriter 11 when subassembly 50 is mounted, and it extends transversely across the righthand portion of the typewriter. On its righthand end, bail 132 extends into an existing hole in the right main frame member of the typewriter. On its lefthand end bail 132 is extended into a slot in a mounting plate 133 which is fastened to existing holes in a central extension of the typewriter main frame. Securely fastened to the lefthand end of locking bail 132 is a character key locking arm 134.

When key lock actuator 123 is energized, an upward pulling motion is imparted to the connecting rod 124. This motion causes transfer link 125 to pivot counterclockwise about the shaft 126. Arm 125A of transfer link 125 is thus moved (upwardly in FIG. 9) toward the front of typewriter 11, while arm 125B is moved (downwardly) toward the rear of typewriter 11. The upward movement of arm 125A causes function key locking plate 128 to pivot. When keyboard locking mechanism 120 is mounted to typewriter 11 in the manner shown in FIG. 1, the pivoting motion of the locking plate 128 causes it to contact the four function key interposers 48 in the typewriter, which, as explained above, become unlatched and move to the rear of the typewriter when one of the space, backspace, index or carrier return keys is depressed. Function locking plate 128, when in the locked position (i.e., when actuator 123 is energized) thus prevents the four function key interposers 48 from becoming unlatched and renders these keys in typewriter 11 inoperative.

At the same time, the downward motion of arm 125B of transfer link 125 causes a downward force to be exerted on the extension 130 attached to character key lock bail 132. Bail 132 is thus forced to pivot, and the character key locking arm 134 attached thereto is caused to engage a knee-like portion 135 of the cycle clutch latch link 136 in typewriter 11. As shown in FIG. 1 on page 12 of the Manual, the cycle clutch latch link 136 in the Selectric typewriter normally moves toward the front of the typewriter when a character key is depressed, so as to actuate the cycle clutch mechanism and initiate a print cycle. Character key locking arm 134, when in a locked position (i.e., when actuator 123 is energized), prevents cycle clutch latch link 136 from moving toward the front of typewriter 11 and thus renders inoperative the character keys of the typewriter.

A transfer link spring 137 and character locking arm spring 138 are positioned so that they restore key locking plate 128 and character key locking arm 134, respectively to a position to disengage the function key interposers and the cycle clutch latch link 136, respectively, when actuator 123 is not energized. The termination of an applied input signal to actuator 123 thus returns keyboard lock mechanism 120 and typewriter 11 to a normal typing mode.

Figure 10B:
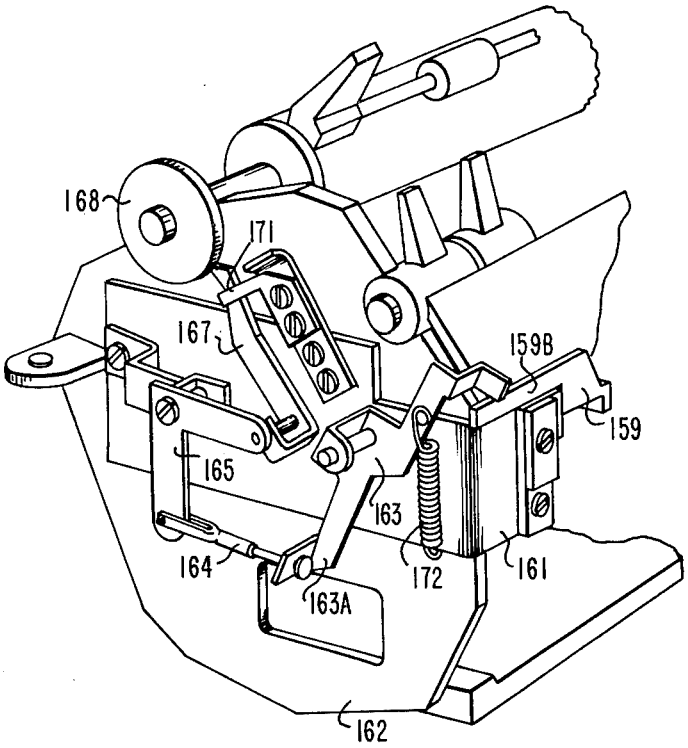
FIG. 10, comprising FIGS. 10A and 10B, constitutes a perspective view of a combined forward and reverse indexing mechanism for use in an automated machine of the type shown in FIGS. 1 through 4.
Figure 10A:
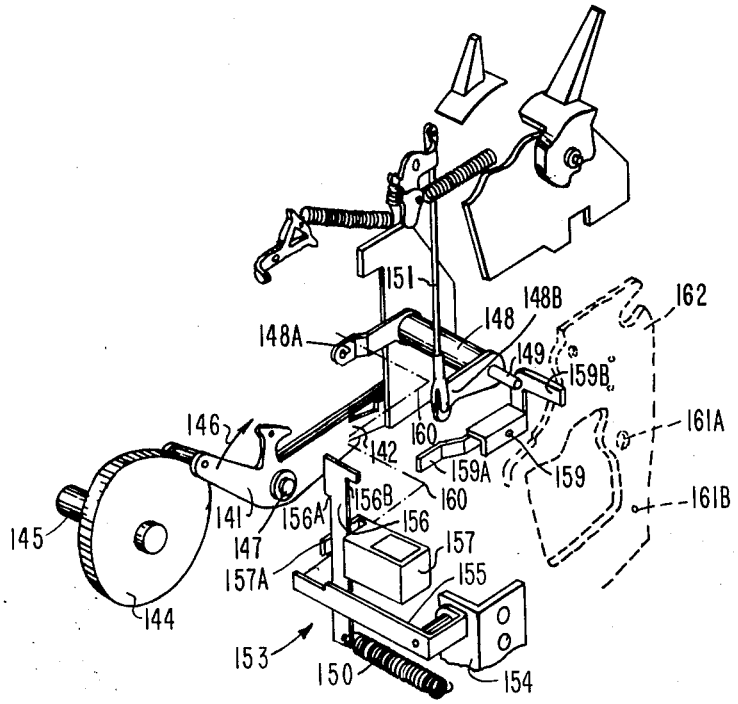

FIGS. 10A and 10B of the drawing illustrate the structure and operation of a combined forward and reverse indexing mechanism for use in the automatic typewriter described herein. As is well known, the indexing mechanism in a conventional Selectric typewriter is a forward indexing mechanism which rotates the platen so that the writing line is advanced vertically to a line below the original writing line on the paper. An index operation is obtained either by depressing an index key on the keyboard or by depressing the carrier return key. Depression of the carrier return key also causes the printing head carrier to move to the left margin of the writing line, whereas depression of the index key causes only an index operation.

A reverse indexing mechanism is one which is used to rotate the platen so that the writing line is moved vertically to a line above the original line on the paper. By incorporating both the standard (forward) indexing mechanism and reverse indexing mechanism in a machine, both subscript and superscript operations are possible.

FIG. 10A herein is a right front perspective view, partly exploded, of a structure which can be combined with the standard indexing mechanism of the Selectric typewriter to enable both forward and reverse indexing operations. As shown in FIG. 10A, and as explained on page 83 of the Manual, the standard forward indexing mechanism in a Selectric typewriter is operated from a cam follower 141 by means of a multiplying lever 142, an index transfer bellcrank 148 and an index link (not shown in FIG. 10A, but shown in FIG. 5 on page 83 of the Manual) which is pivotally mounted at one end of the multiplying level 142 and at the other end to the arm 148A of the index transfer bellcrank 148. Depression of the index key on the typewriter unlatches an index interposer, as explained above, and engages an index clutch mechanism and index cam 144 attached to the power shaft 145 in the typewriter, causing cam 144 to rotate with the power shaft 145. The rotation of the cam causes cam follower 141 to move in the direction indicated by the arrow 146 in FIG. 10A.

Since cam follower 141 is pivotally mounted on a shaft 147, a downward pulling motion is imparted to the index link (not shown) through the lever 142. This downward motion is imparted to an arm 148A of index transfer bellcrank 148 which is pivotally mounted to a shaft 149. Arm 148B of index transfer bell crank 148 thereupon imparts the downward motion to an index pawl link 151. Link 151 operates the index pawl and forward index ratchet (not shown in FIG. 10A here but illustrated in FIG. 6 on page 83 of the Manual), which rotate the platen to a writing line below the original writing line on the paper.

To modify the standard Selectric indexing mechanism for both forward and reverse indexing operations, the index link which connects the multiplying lever 142 and the arm 148A of the bellcrank 148 is first disconnected from cam follower 141 and index transfer bellcrank 148, and discarded. A common forward and reverse indexing actuator arm assembly, shown generally as 153 in FIG. 10A is substituted therefor. Actuator arm assembly 153 includes an auxiliary mounting bracket 154, an actuator lever 155 pivotally connected to bracket 154, an actuator arm 156 pivotally connected to actuator lever 155 and extending upwardly therefrom and an index actuating electromagnet 157 including attractable clapper 157A which is pivotally mounted to electromagnet 157 and which engages a central portion of actuator arm 156. Spring 150 attached to the lower end of actuator arm 156 holds actuation arm 156 and clapper 157A normally away from electromagnet 157.

Actuator arm assembly 153 is operatively disposed in typewriter 11 by moving it into position as generally indicated by the dashed line 160 with bracket 154 secured in position using existing holes 161A and 161B in the right hand member 162 of the typewriter main frame. Actuator lever 155 is then situated directly below the rear portion of cam follower 141. Also, a tab 156A extending to the left from the upper portion of actuator arm 156 is disposed directly above the left arm 148A of index transfer bellcrank 148.

When electromagnet 157 is not energized, the modified structure of FIG. 10A allows the forward indexing mechanism of the standard Selectric typewriter to operate in the conventional manner. Downward motion imparted to the rear of cam follower 141 is transferred through actuator lever 155, actuator arm 156 to index transfer bellcrank 148 and thence to index pawl link 151 and finally to the index pawl and forward ratchet attached to the platen, resulting in a forward indexing operation. When electromagnet 157 is energized, however, clapper 157A is attracted thereto, drawing actuator arm 156 to the right and away from index transfer bellcrank 148. The forward indexing mechanism in the typewriter is thereby deactivated, even though actuator lever 155 and actuator arm 156 still experience a downward movement when cam follower 141 is moved.

As shown in FIG. 10A, a reverse index transfer link 159 is disposed so that it can be pivotally mounted by means of a suitable mounting bracket (not shown) to the inside surface of main frame member 162. Link 159 includes a front arm 159A extending toward the front of typewriter 11 and a rear arm 159B extending to the right of typewriter 11. When electromagnet 157 is energized, moving actuator arm 156 to the right, the tab 156B extending to the right from the upper portion of actuator arm 156 moves directly over the top of the front portion 159A of link 159. A downward motion imparted to actuator arm 156 thus causes link 159 to pivot in a counterclockwise direction, causing the rear portion 159A of the link to move upwardly.

FIG. 10B is a right-rear perpective view of the structure shown in FIG. 10A. Pivotally mounted by means of a auxiliary bracket 161 to existing holes in main frame member 162 is a reverse index transfer link 163. Illustratively, the bracket 161 extends along both sides of main frame member 162 and is used to attach both links 159 and 163. The lower arm 163A of link 163 is connected by means of a threaded rod and clevis pin arrangement 164 to a reverse index pawl arm 165 which is pivotally mounted to bracket 161. Pawl arm 165 is in turn connected to a reverse index pawl 167 which is in position to engage a reverse index ratchet 168 attached to the typewriter platen on the outside of main frame member 162.

From FIG. 10B, it can be seen that upward movement of the rear portion 159B of the link 159 causes link 163 to move the lower part of reverse index pawl arm 165 to the rear of the typewriter. The upper part of pawl arm 165 then pushes reverse index pawl 167 upwardly against reverse index ratchet 168, resulting in a counter-clockwise (reverse) movement of the typewriter platen. A pawl overthrow stop 171, which is mounted to auxiliary bracket 161, prevents further movement of pawl 167 when the typewriter platen has reached the desired position. A spring 172 disengages pawl 167 from ratchet 168 when the desired indexing operation is completed.

Thus, with the structure illustrated in FIGS. 10A and 10B the system can initiate either a reverse or forward indexing operation in typewriter 11 depending upon whether electromagnet 157 is energized or not. Advantageously, the same index clutch mechanism, cam and cam follower in the typewriter are used for both operations. Electromagnet 157 can be energized to initiate a reverse indexing operation either from a control key external to the typewriter (e.g., in a control unit used in conjunction with the typewriter), or from a special reverse index key incorporated as part of the typewriter keyboard.

Figure 11:
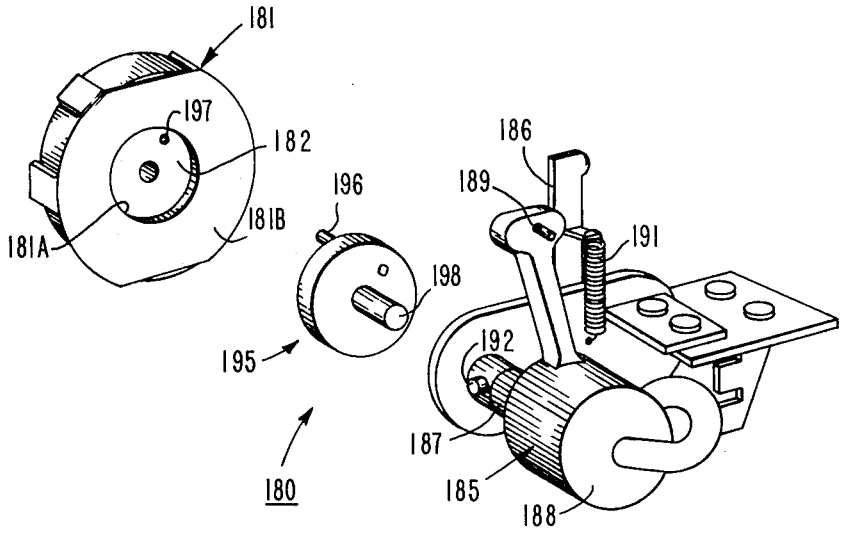
FIG. 11 is an exploded perspective view of a fluid clutch adapter for use in a tabulator sensing mechanism in an automated machine of the type shown in FIGS. 1 through 4.

As noted above, the tabulator mechanism in typewriter 11 allows the operator to move the printing head carrier automatically to the right to a preset position on the writing line. Since the time it takes for the carrier to move to its new position is typically longer than the time it takes for the typewriter to respond to additional input data and to print additional characters, it is important that the additional data be delayed until the carrier and printing head are in position for receiving them. FIG. 11 of the drawings herein illustrates an assembly for accomplishing this result.

More specifically, as shown in FIG. 11, an assembly 180 operates in conjunction with the typewriter main spring 181, which is located at the rear of typewriter 11 just to the left of the typewriter motor (see FIG. 3). As is shown in the Manual, it is the tension of main spring 181 that drives the carrier to the right during a tabulation operation. When released, a central hub 182 in main spring 181 rotates, applying the necessary tension to drive the carrier to its new position. Main spring 181 is rewound every time a carrier return operation is effected. By sensing the rotary motion of central hub 182, it is possible to sense the time period during which the typewriter carrier is in motion in the tabulation operation.

The rotary motion of central hub 182 is sensed by a fluid clutch 185 and reed switch 186. Fluid clutch 185 consists of a hollow shaft 187 pivotally mounted in a cannister 188 which is filled with a viscous fluid such as a heavy oil. The shaft 187 of fluid clutch 185 is disposed so that it rotates with central hub 182 of main spring 181. Extending from the cannister of fluid clutch 185 is an arm which carries a permanent magnet 189. Attached to an auxiliary bracket near fluid clutch 185 is a reed switch 186. When central hub 182 of main spring 181 rotates, shaft 187 also rotates. The viscosity of the fluid in cannister 188 causes the cannister also to rotate, bringing permanent magnet 189 in juxtaposition to reed switch 186. Permanent magnet 189 thus causes the contacts of reed switch 186 to close.

The closing of reed switch 186 generates an electrical signal which signifies that the typewriter is in the process of completing the tabulation operation and that any additional data should be held up until the operation is completed. Spring 191 biases permanent magnet 189 away from reed switch 186. Thus, when central hub 182 of main spring 181 stops rotating (i.e., when the carrier has reached its new position), permanent magnet 189 moves away from reed switch 186 and opens the switch, thus signifying the end of the tabulation process.

The fluid clutch and reed switch assembly described generally has been used in prior automatic typewriters. In order to operatively connect shaft 187 of fluid clutch 185 to mainspring 181 in such typewriters, the mainspring hub 182 is replaced with a specially designed mainspring hub having a shaft extending therefrom. This shaft can then be inserted and secured within hollow shaft 187 of fluid clutch 185 by set screw 192.

FIG. 11 shows an inexpensive adapter 195 which facilitates the attachment of fluid clutch 185 to the existing main spring 181. Adapter 195 consists of a circular disk of diameter slightly smaller than the diameter of the hole 181A in the casing 181B of main spring 181 through which central hub 182 is exposed. One side of the disk includes an eccentrically located pin 196 which fits a pre-existing hole 197 in central hub 182 formed by the main spring. The other side of the disk includes a counter-extending center shaft 198 which can be inserted and secured within hollow shaft 187 of fluid clutch 185 by means of a set screw 192.

Adapter 195 is operatively disposed simply by inserting pin 196 into hole 197 in central hub 182 of main spring 181. Hollow shaft 187 of fluid clutch 185 is then slid into shaft 198 and set screw 192 tightened. The auxiliary bracket supporting fluid clutch 185 and reed switch 186 is then secured to existing holes in the typewriter main frame. With adapter 195, no modification of the standard typewriter mainspring 181 is required. Additionally, the adapter, by itself, is simple and inexpensive to fabricate.

In summary, there has been disclosed apparatus for converting a conventional code responsive, bail operated electric mechanism into an automatic typewriter. The apparatus comprises discrete assemblies which fit into existing hollows of the typewriter mechanism. Consequently, the overall profile of the existing typewriter mechanism does not change so the original typewriter case can be used. This feature reduces overall costs. Moreover, the typewriter appears to the typist like any conventional typewriter with no change in keyboard height. Thus, the typist's orientation to the automatic typing system is reduced as compared to other systems.

This invention has been described with respect to specially constructed assemblies. It will be apparent, however, that the structure of each assembly can be altered without detracting from the advantages provided by this invention. For example, as shown in FIGS. 1 and 6 herein, there is a vacant location between electromagnets 53C and 53D of assembly 50. Some versions of bail operated, code responsive electric typewriter 11 include a power tabulation mechanism which is operated through an interposer, like interposers 48 (FIG. 1) for the space, backspace, index and carrier return mechanisms. For such a version, the vacant location between electromagnets 53C and 53D would be occupied by an additional power tab electromagnet for initiating a power tab operation in the typewriter in response to an input electrical code signal representative thereof. This power tab electromagnet would include a transfer link, like links 55 for operatively engaging the power tab interposer.

Additionally, while an automatic typewriter has been illustratively described which has both electrical code signal generatng and electrical code signal response capabilities, it is possible to convert a conventional typewriter in accordance with this invention to include one, but not the other, of these capabilities. For example, if the converted typewriter is to be used solely as an input signal responsive device (e.g., an automatic printer), the sensing switches in the various assemblies can be left idle, disconnected or eliminated. Similarly, if the converted typewriter is to be used solely as an output signal generating device (e.g., an output terminal), the actuators in the various assemblies can be left idle, disconnected or eliminated.

Therefore, the object of the appended claims is to cover all such variations and modifications as come within the true spirit and scope of this invention.

What we claim as new and desire to secure by Letters Patent of the United States is:

1. Apparatus for converting a code responsive, bail operated, electric typewriter for use as an automatic typewriter, the typewriter prior to its conversion including a typewriter mechanism, a frame supporting the mechanism and a case enclosing the mechanism, the typewriter mechanism including a rotatable platen, a unitary printing head, character keys and function keys, a plurality of latch interposers spaced side-by-side in the mechanism and movable in response to actuation of one of the character or function keys and means coupled to the latch interposers for operating the printing head and the platen in response to coded combinations of latch interposer movements, the mechanism defining a plurality of separate cavities, said conversion apparatus comprising:

A. a first integrally connected group of sensing switches, each of said sensing switches including means for engaging one of the latch interposers associated with the character keys without direct physical attachment thereto and means for developing output electrical code signals in response to movement of the latch interposer as a result of actuation of the character keys;

B. a first integrally connected group of actuators, each of said actuators including means for engaging one of the latch interposers associated with the character keys without direct physical attachment thereto and means for initiating movement of the latch interposers in response to input electrical code signals representative of actuation of the character keys;

C. a second integrally connected group of sensing switches, each of said sensing switches in the second group including means for engaging a portion of the printing head and platen operating means without direct physical attachment thereto and means for developing output electrical code signals in response to movement of the printing head and platen operating means as a result of actuation of the function keys;

D. a second integrally connected group of actuators, each of said actuators in the second group including means for engaging one of the latch interposers associated with the function keys without direct physical attachment thereto and means for initiating movement of the latch interposer in response to input electrical code signals representative of actuation of the function keys; and E. at least first and second separate means for mounting said first and second groups of sensing switches and actuators within selected ones of the cavities defined by the typewriter mechanism so that the overall profile of the typewriter mechanism does not change and so that the case which encloses the mechanism also encloses said mounting means and said first and second groups of sensing switches and actuators.

2. Conversion apparatus as recited in claim 1 further comprising a main mounting bracket attached to the bottom of the frame, said mounting bracket having a first portion extending transversely across the central area of the mechanism and a second, coplanar portion extending rearwardly therefrom along one side of the mechanism.

3. Conversion apparatus as recited in claim 2 wherein the typewriter mechanism includes adjustment means and wherein said first and second mounting means comprise at least two separate auxiliary brackets for supporting the first and second groups of sensing switches and actuators, said auxiliary brackets being mounted at spaced positions to said main mounting bracket so as to position the sensing switches and actuators for engagement with the the latch interposers and the printing head and platen operating means portions and to provide access to the adjustment means

4. Conversion apparatus as recited in claim 2 in which the first group of sensing switches and the first group of actuators are integrally connected together to form a first discrete assembly attached to a first auxiliary bracket which is mounted at one end directly to the frame and at the other end to said main mounting bracket, the first assembly being dimensioned so as to fit entirely within a first existing cavity in the mechanism.

5. Conversion apparatus as recited in claim 4 in which the second group of sensing switches form a second discrete assembly attached to a second auxiliary bracket which is mounted to said main mounting bracket the second assembly being physically separate from the first assembly and being located in a second cavity in the mechanism.

6. Conversion apparatus as recited in claim 5 in which the second group of actuators form a third discrete assembly attached to a third auxiliary bracket which is mounted at one end directly to the frame and at the other end to said main mounting bracket, said third assembly being physically separate from the first and second assemblies and being located in a third cavity in the mechanism.

7. Conversion apparatus as recited in claim 4 in which said sensing switches and actuators in said first assembly are each attached side-by-side to the same side of the first auxiliary bracket facing toward the character latch interposers they engage in the mechanism and in which each of the character latch interposers is engaged by one of said sensing switches and one of said actuators in said first assembly, whereby movement of an individual one of the character latch interposers results in operation of its associated sensing switch and whereby actuation of an individual one of the actuators results in movement of its associated character latch interposer.

8. Conversion apparatus as recited in claim 5 in which each of said sensing switches in said second assembly is attached to the same side of said second auxiliary bracket facing toward the printing head and platen operating means portion they sense, and in which each of the sensing switches in the second assembly engages a different portion of said operating means, whereby movement of an individual portion of said operating means results in operation of its associated sensing switch.

9. Conversion apparatus as recited in claim 6 in which said actuators in said third assembly are attached side-by-side to the same side of said third auxiliary bracket facing away from the function latch interposers they engage in the mechanism, and in which each of the actuators in the third assembly includes a trasfer link for engaging a specific one of the function latch interposers, whereby actuation of an individual actuator results in movement of its associated function latch interposer.

10. Apparatus for converting a code responsive, bail operated, electric typewriter for use as an automatic typewriter, the typewriter prior to its conversion including a typewriter mechanism, a frame for supporting the mechanism and a case for enclosing the mechanism, the typewriter mechanism including a rotatable platen, a unitary printing head, a plurality of depressible character keys, a plurality of depressible function keys, a plurality of character latch interposers spaced side-by-side in the mechanism and movable in response to depression of one of the character keys, a plurality of function latch interposers spaced siee-by-side in the mechanism and movable in response to depression of one of the function keys, means coupled to the character latch and function latch interposers for operating the printing head and platen in response to coded combinations of latch interposer movements, the typewriter mechanism defining a plurality of separate cavities, said conversion apparatus comprising:

A. a main mounting bracket attached directly to the bottom of the frame, said main bracket having a first portion extending transversely across a central area of the mechanism and a second, coplanar portion extending rearwardly along one side of the mechanism;

B. a discrete character sensing and actuating assembly incorporated within a first of the cavities in the mechanism for sensing movement of and for actuating the character latch interposers including
i. a character sensor and actuator assembly bracket that is mounted at one end directly to the frame and at the other end to said main bracket,
ii. a plurality of character sensing switches mounted side-by-side on the character sensor and actuator bracket, each of said character sensing switches including means for engaging a first portion of one of the character latch interposers without direct physical attachment thereto and means for developing output electrical code signals in response to movement of the character latch interposer as a result of depression of the character keys;
III. a plurality of character actuators mounted side-by-side on the character sensor and actuator bracket, each of said character actuators including means for engaging a second portion of one of the character latch interposers without direct physical attachment thereto and means for initiating movement of the character latch interposer in response to the reception of input electrical code signals representative of the depression of the character keys;
C. a discrete function sensing assembly incorporated within a second of the cavities in the mechanism for sensing operation of the means for operating the printing head and platen including
i. a function sensor bracket mounted to said main bracket,
ii. a plurality of function sensing switches mounted on the function sensor bracket, each of said function sensing switches including means for engaging a selected portion of the means for operating the printing head and platen without direct physical attachment thereto and means for developing output electrical code signals in response to movement of that selected portion as a result of depression of the function keys;
D. a discrete function assembly incorporated within a third of the cavities in the mechanism for actuating the function latch interposers including:
i. a function actuator bracket which is mounted at one end directly to the frame and at the other end to said main bracket,
ii. a plurality of function actuators mounted side-by-side on the function actuator bracket, each of said function actuators including means for engaging a portion of one of the function latch interposers without direct physical attachment thereto and means for initiating movement of the function latch interposer in response to the reception of input electrical code signals representative of the depression of the function keys;
E. said assemblies being separately mounted within the respective cavities in the mechanism so that the overall profile of the mechanism does not change and so that the case which encloses the mechanism also encloses said mounting bracket and each of said assemblies.

11. Conversion apparatus as recited in claim 10 in which said typewriter mechanism is of the type including a rotatable filter shaft and a cycle bail which is engaged by depression of the character and function keys to transmit drive by rotation of said filter shaft to said printing head, and in which said function actuating assembly further includes a print cycle electromagnetic actuator mounted on the function actuator bracket with said function actuators for engaging said cycle bail in response to the reception of an input electrical code signal and for moving said cycle bail to transmit drive by rotation of said filter shaft to said printing head.

12. Conversion apparatus as recited in claim 11 further comprising:
A. a timing assembly including
i. a two-lobe cam mounted on one end of said filter shaft,
ii. a timing switch mounted to an angled projection of said first portion of said main mounting bracket for engaging said two-lobe cam and for sensing every half revolution of said filter shaft and developing an output electrical code signal therefor.

13. Conversion apparatus as recited in claim 10 further including an alignment plate secured to said first portion of said main bracket and including an edge for supporting one end of said character sensor and actuator bracket and for aligning said character sensing switches and actuators for engagement with the character latch interposers.

14. Conversion apparatus as recited in claim 10 in which said typewriter mechanism is of the type further including an upper case shaft mechanism comprising at least one depressible shift key, a pivotally mounted shift release arm which is engaged by depression of the shift key, and a pivotally mounted shift arm which is engaged by said shift release arm and which moves to shift said printing head into position for upper case printing, said apparatus further comprising:
A. a shift actuating assembly incorporated within a fourth of the cavities in the mechanism including,
i. a shift actuator bracket which is mounted to a projection of said function actuator bracket,
ii. a shift magnetic actuator mounted to said shift actuator bracket for initiating movement of said shift release arm in response to the reception of an input electrical code signal representative of an upper case shift, and
B. a shift sensing assembly incorporated within a fifth of the cavities in the mechanism including,
i. a shift sensor bracket which is mounted to an angled projection of said second portion of said main bracket;
ii. a shift sensing switch mounted to said shift sensor bracket for sensing movement of said shift arm and for developing an output electrical code signal in response to the depression of the shift key.

15. Conversion apparatus as recited in claim 14 in which said mechanism is of the type further including a bellringer bail which pivots when said printing head approaches the end of a printing line, and in which said conversion apparatus further comprises:
A. an end of line sensing assembly including
i. an end of line sensor bracket which is mounted to said shift actuator bracket,
ii. an end of line sensing switch mounted to said end of line sensor bracket for sensing the movement of said bellrinber bail and for developing an output electrical code signal when said printing head reaches the end of a printing line.

16. Conversion apparatus as recited in claim 15 in which said typewriter mechanism is of the type further including a dual velocity selection linkage for changing the velocity with which printing head operates as a result of the depression of selected ones of the character keys, and in which said conversion apparatus further comprises:

A. a dual velocity actuating assembly including
   i. a dual velocity magnetic actuator mounted to said end of line sensor bracket for engaging and moving said dual velocity selection linkage in response to the reception of input electrical code signals repesentative of the depression of said selected ones of the character keys thereby changing the velocity with which said printing head operates.

17. Conversion apparatus as recited in claim 14 further comprising:

A. a special code signal generating assembly including
   i. a special code signal assembly bracket mounted to said shift actuator,
   ii. a three-position switch mounted to said special code signal assembly bracket, a first position of said threeposition switch generating a first special output electrical code signal which enables the printing of multiple characters in a given space of the printing line, a second position of said three position switch generating a second special output electrical code signal which actuates one of said function actuators in said function actuating assembly to move said printing head to a space at the beginning of a new printing line and which inhibits the further reception of input electrical code signals, and a third, neutral position of said threeposition switch generating neither of said first and second special code signals.

18. Conversion apparatus as recited in claim 10 in which said typewriter mechanism is of the type further including a tabulation mechanism comprising a depressible tab key, a tab key lever moveable by depression of said tab key, a pivotally mounted tab bellcrank which is engaged by depression of the tab key to initiate a tabulation operation of said printing head, said conversion apparatus further comprising:

A. a tab actuating assembly incorporated within a sixth of the cavities defined by the mechanism including
   i. a tab actuator bracket which is mounted to the frame,
   ii. a tab actuator mounted to said tab actuator bracket for initiating movement of said tab bellcrank in response to the reception of an input electrical code signal representative of a tabulation operation, and B. a tab sensing assembly including
   i. a tab sensing switch for sensing movement of said tab key lever and for developing an output electrical code signal in response to depression of said tab key, said tab switch being mounted to an angled projection of said character sensor and actuator bracket.

19. Conversion apparatus as recited in claim 18 in which said typewriter mechanism is of the type further including a tab set and clear mechanism comprising a tab set and clear key pivotally mounted to the frame, a tab set and clear linkage for setting and clearing, respectively, a tab stop position for said printing head on the printing line, said tab and set key being depressible into a first, tab set position to initiate a tab set operation and into a second, tab clear position to initiate a tab clear operation, and in which said conversion apparatus further comprises:

A. a tab set and clear assembly incorporated within a seventh of the cavities defined in the mechanism including
   i. a tab set and clear bracket mounted to the frame,
   ii. a tab set switch mounted to said tab set and clear bracket for sensing the depression of said tab set and key into said tab set position and for developing an electrical code signal responsive thereto,
   iii. a tab clear switch mounted to said tab set and clear bracket for sensing the depression of said tab set and clear key into said tab clear position and for developing an output electrical code signal responsive thereto,
   iv. a tab set actuator for actuating said tab set and clear linkage to set a tab stop position for said printing head on the printing line response to an input electrical code signal representative of a tab set operation, and
   v. a tab clear actuator for actuating said tab set and clear linkage to clear a tab stop position for said printing head on the printing line responsive to an input electrical code signal representative of a tab clear operation.

20. Conversion apparatus as recited in claim 19 in which said tab set switch and said tab clear switch are mounted adjacent to each other on said tab set and clear bracket, in which said tab set actuator and said tab clear actuator comprise an electrically energizable tab set solenoid and an electrically energizable tab clear solenoid, respectively, both of which include a common retractable piston including a radial extension projecting therefrom, and in which said tab set and clear assembly further includes a tab set and clear transfer link pivotally mounted to said tab set and clear bracket, said tab set and clear transfer link including a first arm engaging said tab set and clear key and moveable incooperation therewith, said first arm including a slot into which said radial extension of said piston is disposed, said tab set and clear transfer link including a second arm disposed between said tab set switch and said tab clear switch, said tab set and clear transfer link being positioned so that depression of the tab set position or the tab clear position of said tab set and clear key causes the second arm of said tab set and clear transfer link to close said tab set switch or said tab clear switch, respectively, said tab set and clear solenoids being positioned so that energization of said tab set solenoid attracts said piston thereto causing said radial extension of said piston to move said first arm of said tab set and clear transfer link in a first direction to actuate the tab set position of said tab set and clear key, whereas energization of said tab clear solenoids attracts said piston thereto causing said radial extension of said piston to move said first arm of said tab set and clear transfer link in a second direction to actuate the tab clear position of said tab set and clear key.

21. Conversion apparatus as recited in claim 10 in which said typewriter mechanism is of the type further including a print cycle link which is moveable to initiate a print cycle of said printing head, and in which said conversion apparatus comprises:

A. a key locking assembly including i. a key locking actuator mounted to said function actuator bracket, ii. a first and second key locking brackets mounted to said first main portion of said mounting member, iii. a key locking transfer link including first and second arms and being pivotally mounted to said first key locking bracket, said first arm of said key locking transfer link being connected to said key locking actuator, iv. a function key locking crank plate pivotally mounted to said first and second key locking brackets and being pivotable by movement of said second arm of said key locking transfer link, v. a character key locking bracket mounted to the frame, vi. a character key locking bail pivotally mounted at one end to the frame and at the other end to said character key locking bracket and includng an arm extending therefrom for engaging said first arm of said character locking transfer link, vii. a character key locking arm attached to said character key locking bail and moveable therewith into a position engaging said print cycle link in said typewriter mechanism, whereby energization of said key locking actuator pivots said key locking transfer link causing said second arm thereof to pivot said function key locking crank plate into position to contact and to prevent movement of the function latch interposers in said typewriter mechanism and whereby energization of said key locking actuator pivots said key locking transfer link also causing said first arm thereof to pivot said character key locking bail arm and said character key locking bail to bring said character key locking arm into position to contact said print cycle link in said typewriter mechanism.

22. conversion apparatus as recited in claim 21 in which said key locking assembly further includes means for restoring said function key locking crank plate to a position away from the function latch interposers and for restoring said character key locking arm to a position away from said print cycle link when said key locking actuator is de-energized.

23. Apparatus for converting a code responsive, bail operated, electric typewriter for use as an input electrical code signal responsive printing device, the typewriter prior to its conversion including a typewriter mechanism, a frame for supporting the mechanism and a case for enclosing the mechanism, the typewriter mechanism including a unitary printing head, a plurality of character keys and a plurality of function keys, a plurality of character latch interposers movable in response to actuation of one of the character keys, a plurality of latch interposers movable in response to actuation of one of the function keys, the mechanism defining a plurality of cavities, said apparatus comprising:

A. a first integrally connected group of actuators, each of said actuators including means for engaging the character latch interposers without direct physical attachment thereto and means for initiating movement of the character latch interposers in response to input electrical code signals representative of the actuation of the character keys, B. a second integrally connected group of actuators, each of said actuators in the second group including means for engaging the function latch interposers without direct physical attachment thereto and means for intiating movement of the function latch interposers in response to input electrical code signals representative of the actuation of the function keys, C. first and second separate means for mounting the first and second groups of actuators within separate cavities defined by the typewriter mechanism so that the overall profile of the typewriter mechanism does not change and so that the case which encloses the mechanism also encloses the first and second groups of actuators.

* * * * *

UNITED STATES PATENT AND TRADEMARK OFFICE

CERTIFICATE OF CORRECTION

PATENT NO. : 4,023,664

DATED : May 17, 1977

INVENTOR(S) : Mariano Baffo and William F. Brine, Jr.

It is certified that error appears in the above-identified patent and that said Letters Patent are hereby corrected as shown below:

Abstract, line 1, after "converting" insert --a--
Col. 1, line 65, delete "Apendages" and insert --Appendages--
line 66, delete the comma ","
same line, delete "susceptable" and insert --susceptible--
Col. 2, line 18, delete "exend" and insert --extend--
line 20, delete "baseplace" and insert --baseplate--
Col. 3, line 30, delete "and index mechanisms;"
lines 35 and 36, delete "typewrier" and insert --typewriter--
line 65, delete the comma "," (second occurence) and insert a period --.--
Col. 4, line 43, delete "th" and insert --the--
line 45, delete "mmove" and insert --move--
line 52, delete "tile" and insert --tilt--
Col. 5, line 11, delete "provicdes" and insert --provides--
line 67, delete "At" and insert --A--
Col. 6, lines 17 and 18, delete "alernation" and insert --alteration--
line 64, delete "witout" and insert --without--
Col. 7, line 12, delete "edge" and insert --end--
line 45, delete "53B" and insert --53b--
line 51, delete "53B" and insert --53b--
line 52, delete "53A" and insert --53a--
Col. 8, line 47, delete "61" and insert --to--
Col. 9, line 13, delete "pad" (first occurrence) and insert --switch--
line 58, delete "has" and insert --had--
Col. 10, line 37, delete "lightner" and insert --lighter--
line 44, delete "th" and insert --the--
line 45, delete "acutator" and insert --actuator--
Col. 11, line 23, delete "accomodate" and insert --accommodate--
Col. 13, line 13, delete "is" and insert --to--

UNITED STATES PATENT AND TRADEMARK OFFICE

CERTIFICATE OF CORRECTION

PATENT NO. : 4,023,664
DATED : May 17, 1977
INVENTOR(S) : Mariano Baffo and William F. Brine, Jr.

It is certified that error appears in the above-identified patent and that said Letters Patent are hereby corrected as shown below:

Col. 19, line 52, delete "the" (first occurence)
line 54, after "means" insert a period --.--
line 68, after "bracket" insert a comma --,--

Col. 20, line 55, delete "siee-by-side" and insert -- side-by-side --.

Col. 21, line 18, delete "III" and insert --iii--

Col. 25, line 3, delete "a"
line 39, delete "conversion" and insert --Conversion--

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*